United States Patent [19]

Traiteur

[11] 4,058,381

[45] Nov. 15, 1977

[54] STEAM DRYERS

[75] Inventor: René Traiteur, Ris-Orangis, France

[73] Assignee: Babcock & Wilcox Limited, London, England

[21] Appl. No.: 731,200

[22] Filed: Oct. 12, 1976

[30] Foreign Application Priority Data

Jan. 20, 1976 France ..... 76.01325

[51] Int. Cl.[2] ..... B01D 45/00; B01D 46/10

[52] U.S. Cl. ..... 55/444; 55/489; 55/DIG. 23

[58] Field of Search ..... 55/444, 482, 485, 489, 55/486, 490, DIG. 23

[56] References Cited

U.S. PATENT DOCUMENTS 2,220,127 11/1940 Slayter ..... 55/485

3,360,911 1/1968 Sweeney ..... 55/489

3,923,010 12/1975 Chlique ..... 55/444

*Primary Examiner*—Bernard Nozick

*Attorney, Agent, or Firm*—J. M. Maguire; J. P. Sinnott

[57] ABSTRACT

A typical embodiment of the invention is a steam drying device that has a frame with two recessed slipways spaced from each other. A first array of longitudinally disposed bars within the frame are spaced transversely from each other. The ends of the bars in this first array, moreover, are received within respective slipway recesses. There also is a second array of longitudinal bars, the ends of which are received in respective slipways, the bars in both arrays being transversely spaced from each other to enable the bars to remove water droplets from the steam.

2 Claims, 7 Drawing Figures

STEAM DRYERS

BACKGROUND OF THE INVENTION

1. Field of the invention

This invention relates to apparatus for removing water droplets from steam and, more particularly to arrays of bars within a frame for removing the droplets, and the like.

2. Brief Description of the Prior Art

In some devices grids are disposed side by side in such a way that they can be traversed successively by a current of wet steam, each grid being composed of a network of parallel bars, the bars in one grid being disposed opposite the passage gaps of an adjoining grid. Typically, the bars of two neighboring grids are formed by the same wire. The device then contains a unit composed of two parallel bars rigidly spaced from one another, and a wire wound at constant pitch on these two bars in such a way as to form, on either side of the plane common to the longitudinal axes of the two bars two grids of strands of parallel wires, the strands of one of the grids being offset by a half pitch relative to those of the other.

The object of this invention, however, is to embody a grid structure of simpler and more economical construction. It also intends to insure a good fixation of the bars forming the said grids.

It consists essentially in resorting to sets of bars stacked inside a frame with slideways, the bars in each set forming part, respectively of separate grids, the number of which is equal to the number of bars in the set.

Its object is, more precisely, a steam drying device a power generating station, constituted by grids disposed side by side in such a way that they can be traversed successively by a current of wet steam, each grid being composed of a network of parallel bars, the bars in one grid being disposed opposite passage gaps in an adjacent grid, characterized in that the grids are formed by stacking, inside a frame with slideways, sets of parallel bars situated in a given plane and joined by their ends, the bars in each set which belong, respectively to separate grids being disposed in the gaps separating the bars of an adjacent set.

According to a first form of embodiment the stacked sets exhibit orientations alternating by successive rotations of their respective planes, the sets which exhibit the same orientation being mounted in the same slideways.

According to a second form of embodiment, the stacked sets are alternately offset by successive translations of their respective planes, the sets which exhibit the same offset being mounted in the same slideway.

In a particularly advantageous fashion, the bars in each set are bent at their ends in such a way as to exhibit a U configuration with arms folded down, which fit inside one another, the arms of each bar having a length different from that of the arms of a neighboring bar, in such a way that a gap is formed between the successive bars in each set.

The ends of the bars in each set, constituted by the down-folded parts of their arms, are fixed together, especially by welding.

According to a simplified form of embodiment, each set is constituted by two bars, coupled at their ends, one bar in each set being disposed in the gap separating the two bars in an adjacent set.

The bar in each set disposed in the gap separating the two bars of an adjacent set, is a bar with short arms or long arms.

According to an alternative, each bar in a set is constituted by a rod welded at its ends to arms common to all the rods in the set.

The invention will be better understood by referring to the following description, made with regard to the attached drawings which relate to different forms of embodiment, given by way of non-limiting examples.

Figure 1:
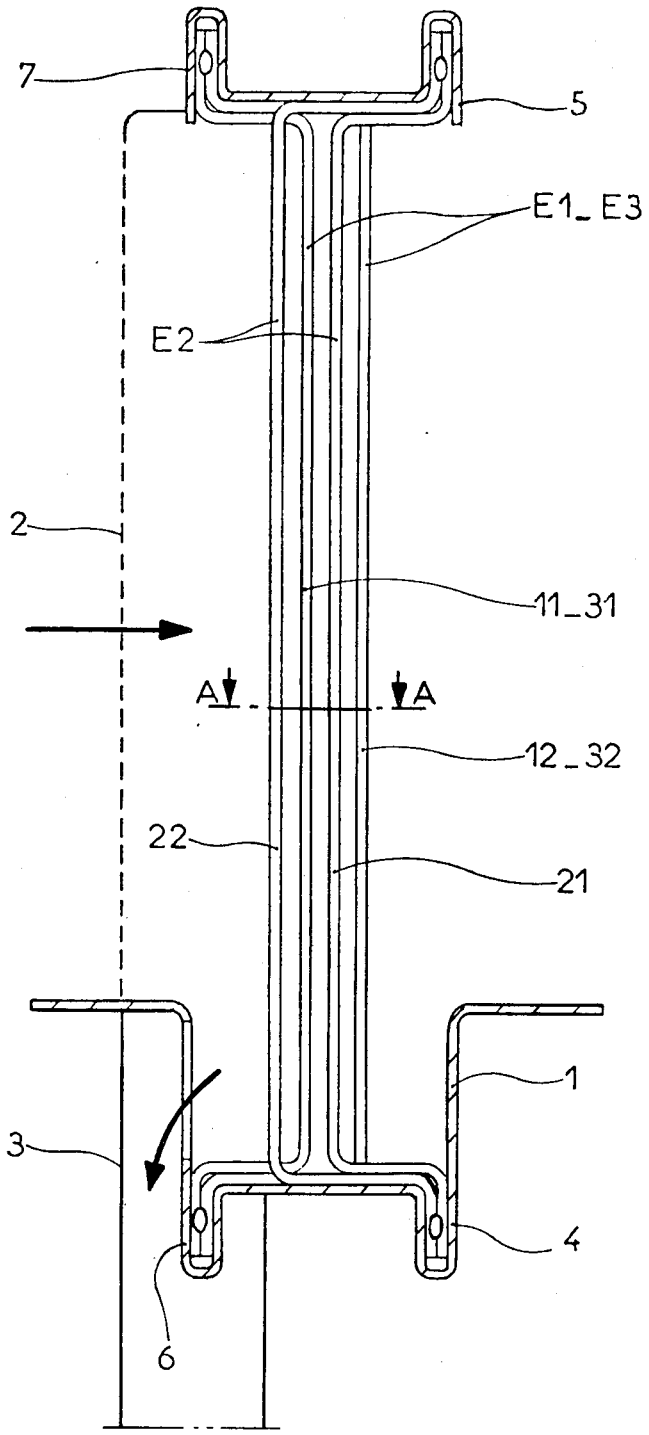
FIG. 1 is an elevation in section of a drying device with four grids according to a first form of the invention.
Figure 2:
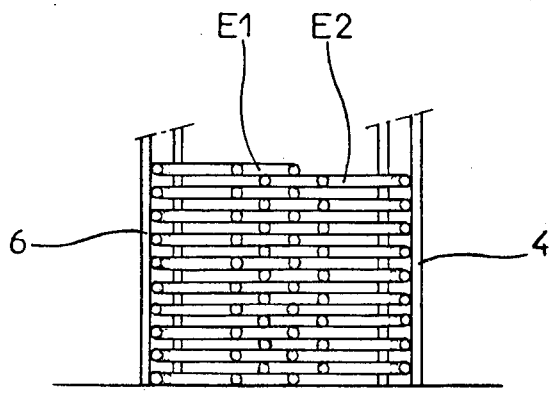
FIG. 2 is a partial view in section of the device along line A—A in FIG. 1.
Figure 3:
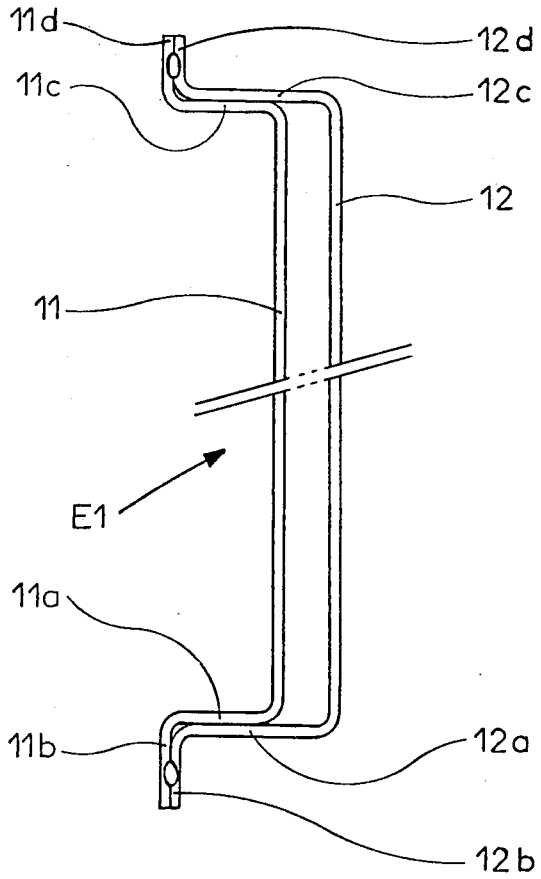
FIG. 3 is a detail view on a larger scale of FIG. 1, showing the assembly of the two bars in a set.

In FIG. 1 to 3, we see a four-grid drying device arranged inside a vertical frame 1. A perforated sheet of metal 2, solid with frame 1, arranged on the frontal face of the device, insures the protection of the latter against any introduction of a foreign body. A tube 3 connected to the lower part of the frame 1, insures the collection and drainage of the droplets of water separated from the wet steam.

The four grids are formed by stacking sets $E_1$, $E_2$, $E_3$ . . . of which we will speak more explicitly below.

Each of the sets, such as $E_1$, is formed of two parallel bars 11 and 12, situated in a given plane and bent at their ends in such a way that each bar exhibits a U configuration with folded-down arms. References **11*a* and 11*b* designate, respectively, the lower arm of bar 11 and the folded-down part of the said arm. References 11*c* and 11*d* designate, respectively, the upper arm of the same bar and its folded-down part. References 12*a*, 12*b*, 12*c* and 12*d* designate the corresponding parts of bar 12. Arms 11*a* and 11*c*, whose length is shorter than that of arms 12 and 12*c*, engage in the latter, in such a way that a gap is formed between bars 11 and 12. The said bars are coupled at their ends by welding the folded-down parts of their arms, 11*b* and 12*b* on the one hand, and 11*d* and 12*d* on the other. The parts welded together are mounted in slideways in frame 1. Parts 11*b* and 12*b* are mounted in a slideway 6 in the lower part of frame 1, while parts 11*d* and 12*d* are mounted in a slideway 7** disposed opposite the preceding.

A set E2 of two bars 21 and 22 exhibits a structure identical to set E1 which is joined after rotation of its plane. The welded ends of bars 21 and 22 are mounted in slideways 4 and 5 of frame 1, disposed opposite one another, slideway 4 being formed in the lower part of frame 1, at the level of slideway 6, and slideway 5 in the upper part of frame 1 at the level of slideway 7.

The sets $E_1$ $E_2$, $E_3$. . . of successively opposite orientation, are mounted alternately in slideways 6 and 7, and in slideways 4 and 5 in frame 1, after each rotation; they form by stacking the set of grids the bars in each set, belonging to distinct grids, being disposed in the gaps separating the bars from an adjacent set.

Figure 4:
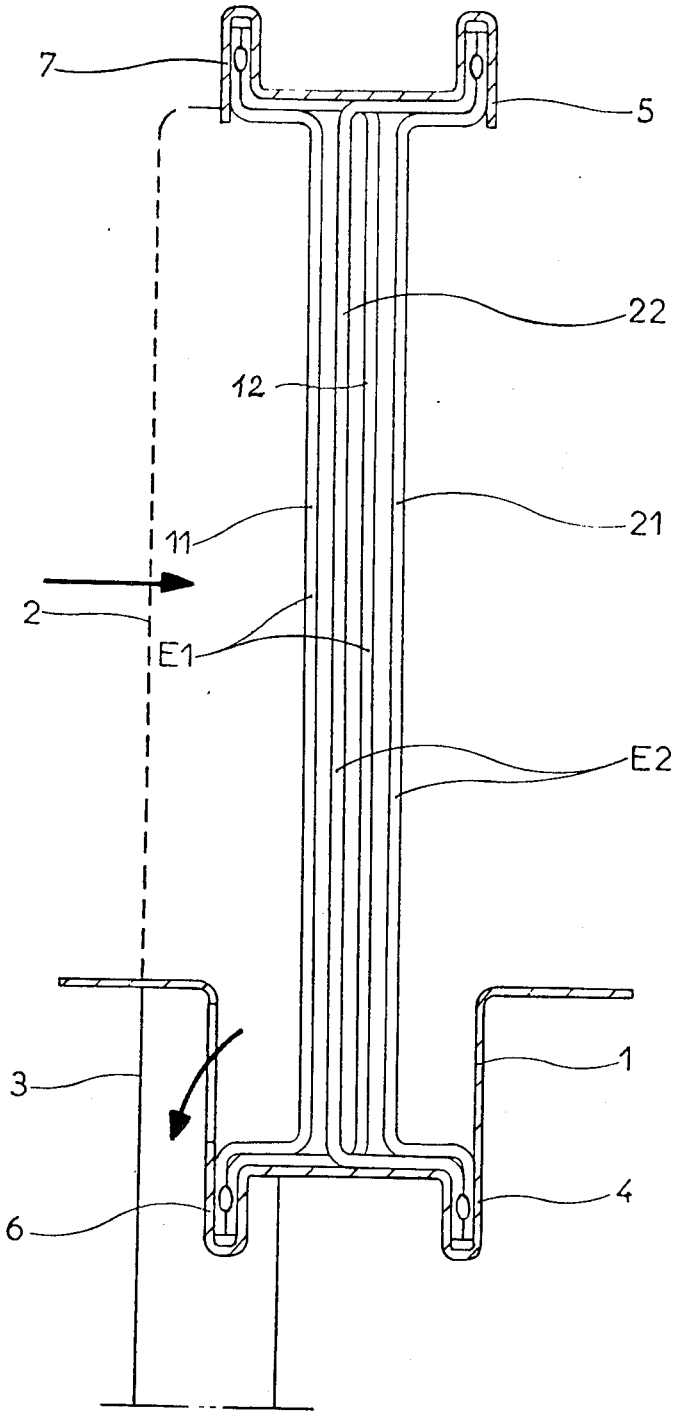
FIG. 4 illustrates, schematically, an alternate assembly of the sets.

In FIG. 4 we see two sets $E_1$ and $E_2$, the first formed by bars 11 and 12, the second by bars 21 and 22. In contrast to the arrangement illustrated in FIG. 1, the bar in each set disposed in the gap separating the two bars of an adjacent set, is a long-armed bar. Long-armed bar 12 in set $E_1$ is situated in the gap separating bars 21 and 22 of set $E_2$. Likewise long-armed bar 22 in set $E_2$ is situated in the gap separating bars 11 and 12 in set $E_1$. Aside from this particular disposition, the arrangement of the bars in the slideways of frame 1 is the same as above.

Figure 5:
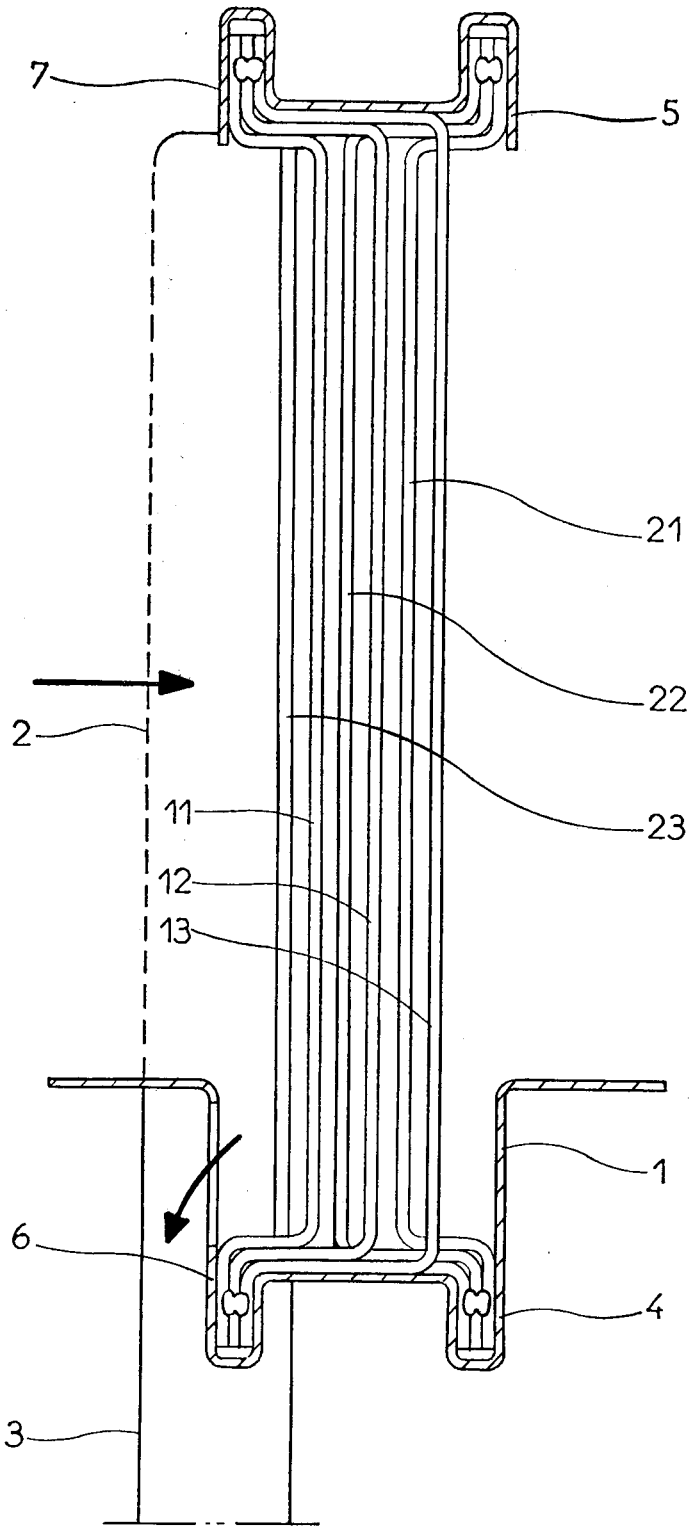
FIG. 5 illustrates, again in schematic form, a stacking of three-bar sets of a six-grid device.

In FIG. 5 the bars 11, 12, 13 form one set in a three bar array that, except for the additional bar 13, is similar to the grid structure that was described in connection with FIG. 4. Further in this respect, the adjacent bar structure in FIG. 5 also is assembled from three bars 21, 22, 23. Aside from the additional bars 13, 23, the particular disposition of the bars in the slideways of the frame 1 is the same as in FIG. 4.

Figure 6:
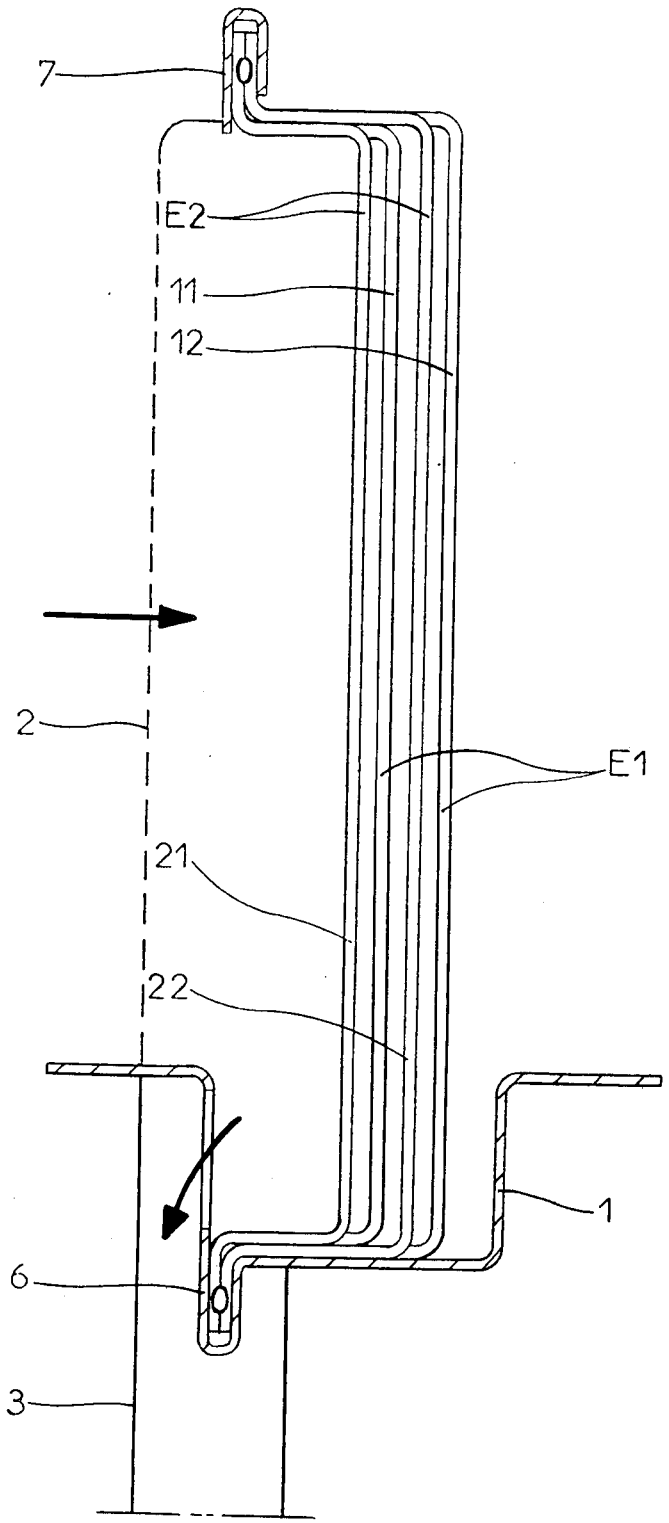
FIG. 6 shows, in a simplified form, a stacking of alternating sets belonging to two different types.

In FIG. 6 we see two sets $E_1$ and $E_2$, each having two bars marked as in the preceding figures. The arms of the two bars in set $E_1$ are longer than the respective arms of the bars in set $E_2$, hence it is possible to mount the two sets inside the same slideways 6 and 7. This form of embodiment makes it possible to simplify the structure of frame 1 and to facilitate assembly by eliminating the rotation of the successive sets. But it requires two distinct types of sets, the odd sets such as $E_1$ on the one hand, and the even sets such as $E_2$ on the other.

Figure 7:
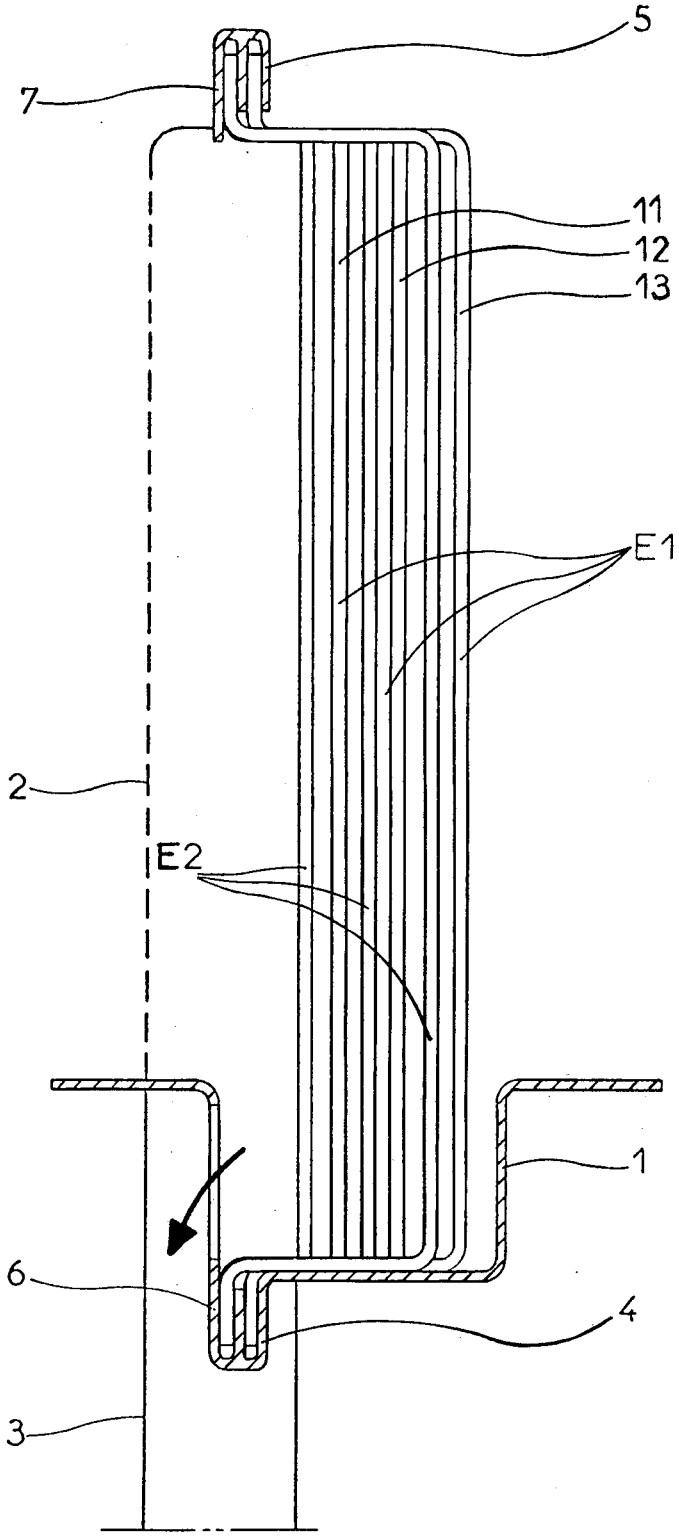
FIG. 7 shows, again in simplified form, a stacking of sets of another type alternately offset.

In FIG. 7 we see two sets $E_1$ and $E_2$, each comprising three bars, the said sets being offset with respect to one another in their respective planes. The sets such as $E_1$ exhibiting the same offset, are mounted in slideways 4 and 5, while the sets such as $E_2$, exhibiting the opposite offset, are mounted in slideways 4 and 5, while the sets such as $E_2$, exhibiting the opposite offset, are mounted in slideways 6 and 7. The latter are disposed on the same side of frame 1 as slideways 4 and 5. The structure of each set is different, here, from that of the sets described above. Each bar in a set, such as bar 11, 12 or 13 in set $E_1$, is constituted by a rod welded at its ends onto arms common to all the rods of the set.

Although the invention has been described in reference to different forms of embodiment, it goes without saying that it is no way limited thereto, and that modifications can be imparted to it without departing from its scope.

We can, for example, resort to sets of the type described in FIG. 7 in order to embody assemblies similar to those illustrated in the preceding figures. Reciprocally, it is possible to stack, in the slideways, sets of the type described in FIG. 2, the said sets being alternately offset as in FIG. 7.

The invention therefore covers, in addition to the examples represented, the various possible alternatives of execution thereof.

The embodiments of the invention in which an exclusive property or privilege is claimed are defined as follows:

1. A steam drying device for removing water droplets from a stream of the steam comprising a frame having a frontal face transverse to the stream, at least two pair of recessed slipways formed therein transverse to said stream, said slipway recesses being spaced from each other, a perforated sheet of metal fixed to said frame to protect the steam drying device from foreign body damage, a first array of longitudinally disposed bars within said frame spaced transversey from each other and downstream from said perforated sheet of metal each of said bars having two ends, each of said ends being fixed to each other within a respective slipway recess, and a second array of longitudinally disposed bars within said frame spaced transversely from each other and from said first array bars and downstream from said perforated sheet of metal, each of said second array bars having two ends, each of said ends being fixed to each other within a respective slipway recess to enable said bars to remove water droplets from the steam.

2. A device according to claim 1 wherein each of said bar ends in said first and second arrays have bent portions to establish a U-shaped configuration for the individual bars, said bent end portions for the respective bars in each of said arrays being of different lengths in order to provide said transverse spacings.

* * * * *